US006978844B2

(12) United States Patent
LaFleur

(10) Patent No.: US 6,978,844 B2
(45) Date of Patent: Dec. 27, 2005

(54) FILLING AND CIRCULATING APPARATUS FOR SUBSURFACE EXPLORATION

(75) Inventor: Karl K. LaFleur, Weatherford, TX (US)

(73) Assignee: LaFleur Petroleum Services, Inc., Weatherford, TX (US)

( * ) Notice: Subject to any disclaimer, the term of this patent is extended or adjusted under 35 U.S.C. 154(b) by 183 days.

(21) Appl. No.: 10/613,190

(22) Filed: Jul. 3, 2003

(65) Prior Publication Data

US 2005/0000695 A1 Jan. 6, 2005

(51) Int. Cl.[7] ..... E21B 23/04; E21B 34/08; E21B 34/14

(52) U.S. Cl. ..... 166/386; 166/212; 166/328; 175/99; 251/149.2; 251/149.6

(58) Field of Search ..... 166/373, 213, 166/382, 381, 383, 90.1, 216, 217, 386, 328, 166/212, 325; 175/99; 137/624.13; 251/149.1, 251/149.2, 149.6

(56) References Cited

U.S. PATENT DOCUMENTS 4,067,358 A * 1/1978 Streich ..... 137/623.13
4,522,430 A 6/1985 Stromberg
4,524,998 A 6/1985 Brisco
4,566,168 A 1/1986 Stromberg
4,613,161 A 9/1986 Brisco
4,624,483 A 11/1986 Stromberg
4,655,286 A 4/1987 Wood
4,718,495 A 1/1988 Lubitz et al.
4,790,381 A * 12/1988 Armell ..... 166/241.5
4,817,724 A 4/1989 Funderburg, Jr. et al.
4,913,231 A 4/1990 Muller et al.
4,944,349 A * 7/1990 Von Gonten, Jr. ..... 166/304
4,997,042 A 3/1991 Jordan et al.
5,044,444 A 9/1991 Coronado
5,152,554 A 10/1992 LaFleur et al.
5,191,939 A 3/1993 Stokley
5,236,035 A 8/1993 Brisco et al.
5,249,629 A 10/1993 Jennings
5,282,653 A 2/1994 LaFleur et al.
5,411,095 A 5/1995 Ehlinger et al.
5,413,171 A 5/1995 Womack
5,435,390 A 7/1995 Baugh et al.
5,441,310 A 8/1995 Barrett et al.
5,443,122 A 8/1995 Brisco
5,499,687 A 3/1996 Lee
5,501,280 A 3/1996 Brisco
5,553,667 A 9/1996 Budde et al.
5,577,566 A 11/1996 Albright et al.
5,584,343 A 12/1996 Coone
5,641,021 A 6/1997 Murray et al.

(Continued)

*Primary Examiner*—David Bagnell
*Assistant Examiner*—Ngoc Kinney
(74) *Attorney, Agent, or Firm*—Haynes and Boone, LLP

(57) ABSTRACT

A disclosure is provided describing a filling and circulating tool and method of use. The filling and circulating tool comprises a tubular housing having a first fluid passage and a longitudinal axis, a movable seal coupled to an exterior of the housing, the seal adapted to substantially block a flow of fluid through the first fluid passage when the seal is in a closed position and to allow the flow of fluid when the seal is in an open position, and an actuating device coupled to the movable seal such that in response to insertion into the casing, the actuating device causes the movable seal to move from the closed position to the open position.

17 Claims, 4 Drawing Sheets

U.S. PATENT DOCUMENTS 5,660,234 A 8/1997 Hebert et al.
5,735,348 A 4/1998 Hawkins, III
5,794,703 A * 8/1998 Newman et al. ..... 166/381
5,971,079 A 10/1999 Mullins
6,173,777 B1 1/2001 Mullins
6,832,656 B2 * 12/2004 Fournier et al. ..... 166/373

* cited by examiner

FILLING AND CIRCULATING APPARATUS FOR SUBSURFACE EXPLORATION

FIELD OF THE INVENTION

This invention relates to filling a portion of casing while it is being run in a wellbore and circulating it to aid in its proper positioning as it is being advanced into the wellbore.

BACKGROUND OF THE INVENTION

Casing for a wellbore that has just been drilled is assembled at the surface as joints are added and the string is lowered into the wellbore. As the joints are added at the surface on the rig floor, it is often desirable to fill the casing with fluid or drilling mud. Filling the casing before it is run into the wellbore prevents pressure imbalances on the casing as it is being advanced into the wellbore. Additionally, once the casing is filled, it may be desirable to circulate through the casing as it is being run into the wellbore. Thus, it is often necessary to use an apparatus for filling and circulating fluids within the casing. When such an apparatus is raised from the casing, fluids may leak onto the well deck, which wastes valuable fluids, may be hazardous to personnel, and could cause environmental issues. Furthermore, such an apparatus may build up excessive back pressure causing potentially dangerous situations. What is needed, therefore, is an apparatus and method which safely allows for the adequate filling and circulating of the casing.

SUMMARY

The present invention relates to a filling and circulating tool and a method of use thereof. The filling and circulating tool comprises a housing having a first fluid passage and a longitudinal axis, a movable seal coupled to an exterior of the housing, the seal adapted to substantially block a flow of fluid through the first fluid passage when the seal is in a closed position and to allow the flow of fluid when the seal is in an open position, and an actuating device coupled to the movable seal such that in response to insertion into the casing, the actuating device causes the movable seal to move from the closed position to the open position.

DESCRIPTION

Figure 1:
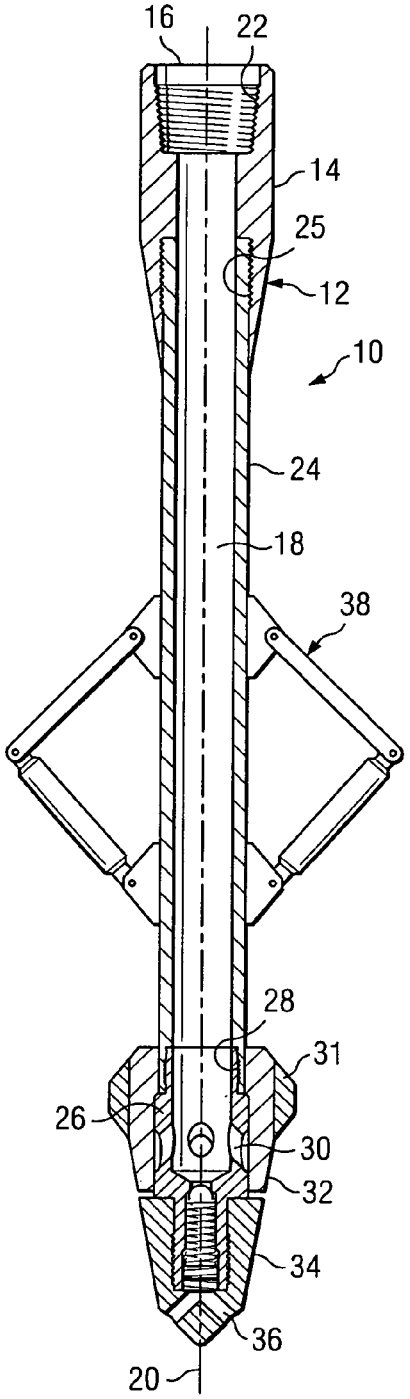
FIG. 1 is a longitudinal cross section of one embodiment of the present invention.

Referring now to FIG. 1, there is shown an embodiment of a filling and circulating tool 10. As will be explained below with reference to the operation of the filling and circulating tool 10, FIG. 1 illustrates a first or "closed" configuration. The filling and circulating tool 10 has an outer housing 12 which is generally cylindrical in shape and encloses the various modules and components of one embodiment of the present invention. At the upper end of the outer housing 12, there is an upper connecting sub 14 which is adapted to be connected to the bottom of a tool string (not shown) in a conventional manner.

A top opening 16 is concentrically located in the upper connecting sub 14. The top opening 16 defines an end of a first fluid passageway or central throughbore 18 which generally runs through the filling and circulating tool 10 along a vertical or longitudinal axis 20. In one embodiment, the upper connecting sub 14 has a threaded inside surface 22 adapted to connect to the tool string (not shown). The lower end of the upper connecting sub 14 may be connected to a tubular shaped mandrel 24 in a conventional manner, for instance, by means of a threaded connection 25. The interior of the mandrel 24 defines a portion of the central throughbore 18. A sealing means, such as a plurality of O-rings (not shown) may provide a sealing engagement between the upper connecting sub 14 and the mandrel 24.

In the illustrative embodiment of FIG. 1, the lower end of the mandrel 24 connects to a valve body 26 in a conventional manner, such as a threaded connection 28. A sealing means, such as a plurality of O-rings (not shown) may provide a sealing engagement between the mandrel 24 and the valve body 26. As will be explained in detail below, the valve body 26 contains a plurality of fluid ports 30 which are in communication with the central throughbore 18. In the configuration illustrated in FIG. 1, a valve sleeve 32 is slidably coupled to the valve body such that the valve sleeve 32 may move longitudinally with respect to the valve body 26 from a "first" or closed position to a "second" or open position. As will be explained in detail below, in the closed position, the valve sleeve 32 covers the fluid ports 30 to prevent fluid from exiting. On the other hand, in the open position, the valve sleeve 32 does not cover the fluid ports 30, allowing fluids to escape. The valve sleeve may have a means of protection, such as a urethane standoff ring 31, to protect against casing and thread damage. Additionally, the standoff ring 31 may act as a guide to assist in centralizing the tool 10 within the casing.

An actuating device 38 may be coupled to the valve sleeve 32. The actuating device 38 causes the valve sleeve 32 to move from the closed position to the open position. A lower end of the valve body 26 may be adapted to be coupled to a nose guide 34 which also contains a plurality of fluid passages 36. The nose guide 34 protects the filling and circulating tool 10 and aids in the insertion of the tool into the casing. The nose guide 34 can also protect the casing threads.

Figure 2:
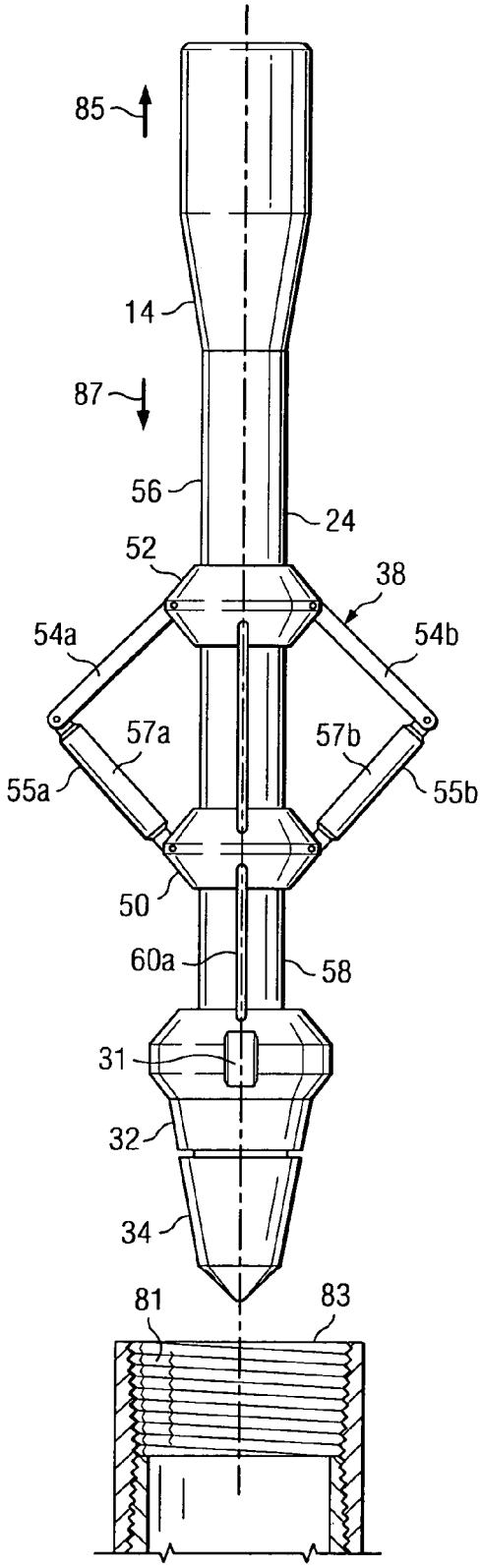
FIG. 2 is an elevation of the embodiment of FIG. 1 illustrating the embodiment in a closed position.

Turning now to FIG. 2, there is an exterior view of the filling and circulating tool 10. In the illustrated embodiment, the actuating device 38 is coupled to the exterior of the mandrel 24. The actuating device 38 may comprise an anchor collar 50, a collar or scissor sleeve 52, and a plurality of scissor arms 54*a* and 54*b*. The anchor collar 50 may be fixedly coupled to the mandrel 24. In alternative embodiments, the anchor collar 50 may function as a connecting sub which connects an upper mandrel 56 to a lower mandrel 58. The plurality of scissor arms 54*a* and 54*b* connects the anchor collar 50 to the scissor sleeve 52 and allows the scissor sleeve 52 to slidingly move longitudinally along the mandrel 24 with respect to the anchor collar 50. Lower segments 55*a* and 55*b* of the the scissor arms 54*a* and 54*b* may have a means of protection, such as urethane thread protectors 57*a* and 57*b* to shield the segments 55*a* and 55*b* when entering a casing.

The scissor sleeve 52 may be coupled to a plurality of connecting rods 60*a* and 60*b* (60*a* is visible in FIG. 2). In one embodiment, the ends of the connecting rods may be threaded. In such an embodiment, a lower end 59*a* of the connecting rod 60*b* may be threadably coupled to the valve sleeve 32. An upper end 59*b* of the connecting rod 60*b* may be positioned within a longitudinal bore (not shown) defined within the scissor sleeve 52. A plurality of locking nuts (not shown) positioned above and below the bore may be used to secure the upper end 59*b* of the connecting rod 60*b* to the scissor sleeve 52. Thus, as illustrated, the connecting rods 60*a* and 60*b* couple the scissor sleeve 52 to the valve sleeve 32 so that when the scissor sleeve 52 moves longitudinally, the valve sleeve 32 will follow with the same relative movement. In some embodiments, a center portion 59*c* of the connecting rods 60*a* and 60*b* may be positioned within and slidingly engage a longitudinal bore (not shown) defined within the anchor collar 50.

Figure 3A:
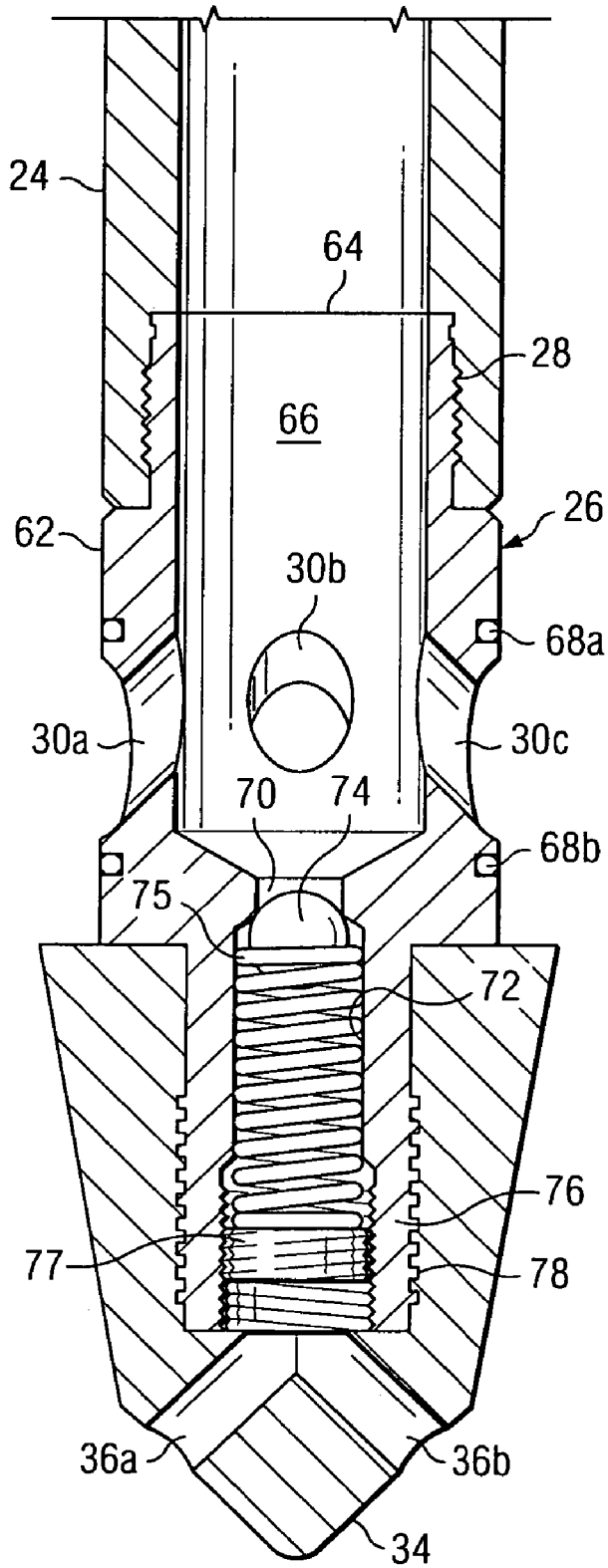
FIG. 3*a* is a detailed cross section of one embodiment of a valve apparatus which could be employed in the embodiment of the present invention.

FIG. 3*a* is a detailed view of one embodiment of the valve body 26. As previously discussed, the upper end of the valve body 26 may be adapted to connect to the lower end of the mandrel 24 in a conventional manner, such as with the threaded connection 28. A top opening 64 is concentrically located in the valve body 26. The top opening 64 defines a concentric bore 66 which is a portion of the central throughbore 18. In the illustrative embodiment, the fluid ports 30*a*–30*d* run through the side walls of the valve body 26 (fluid ports 30*a*, 30*b*, and 30*c* are visible in FIG. 3*a*). A sealing mechanism, such as a plurality of 0-rings 68*a* and 68*b* or U-cup seals (not shown) such as those commercially available from MARCO Rubber Plastic Products, Inc. of North Andover, Mass., provide a seal when the valve sleeve 32 (not shown in FIG. 3*a*) covers the ports 30.

At approximately the middle of the valve body 26, the concentric bore 66 narrows down to a neck 70 and then expands again to create a fluid passage 72. The fluid passage 72 may contain a valve mechanism, such as a nylon ball 74 positioned within the fluid passage 72. A biasing mechanism, such as a helical spring 75, may bias the ball 74 against the neck 70. In the illustrative embodiment, the force exerted by the helical spring 75 against the ball 74 may be adjusted by means of a threaded mechanism 77 positioned within the fluid passage 72.

The bottom portion 76 of the valve body 26 may be coupled to the nose guide 34 by means of a threaded connection 78. The nose guide 34 may be urethane, plastic, brass or another suitable material to protect the valve body 26 and casing threads during use. As will be explained below, the nose guide 34 may have a plurality of fluid passages 36*a* and 36*b* which may allow fluid to escape during times of high back pressure.

Figure 3B:
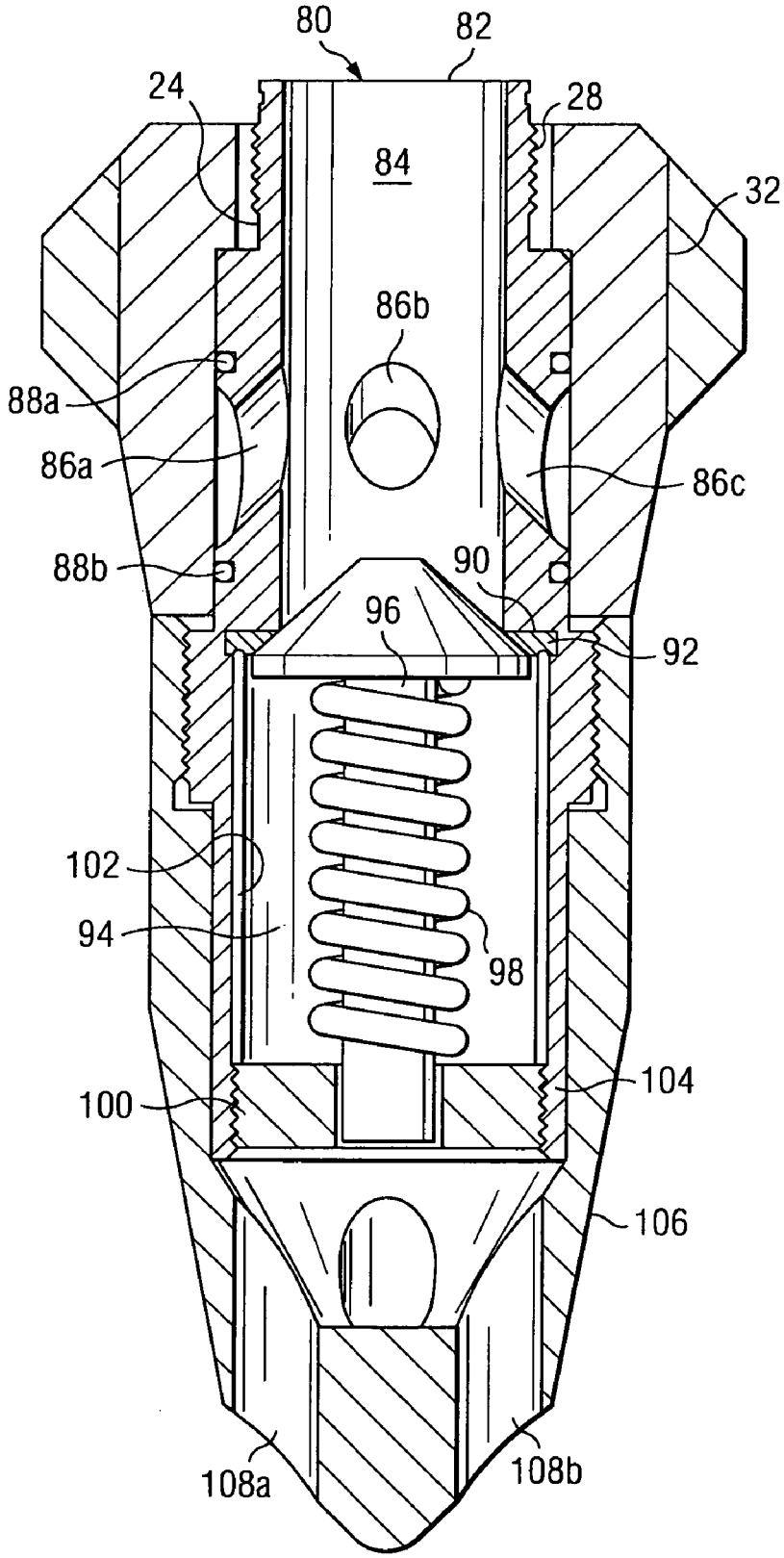
FIG. 3*b* is a detailed cross section of an alternative embodiment of a valve apparatus which could be employed in the embodiment of the present invention.

FIG. 3*b* is a detailed view of an alternative embodiment of a valve body 80. As illustrated, the valve body 80 is similar to the valve body 26 discussed in reference to FIG. 3*a*. The upper end of the valve body 80 may be adapted to connect to the lower end of the mandrel 24 in a conventional manner, such as with the threaded connection 28. A top opening 82 is concentrically located within the valve body 80. The top opening 82 defines a concentric bore 84 which may be a portion of the central throughbore 18. In the illustrative embodiment, the fluid ports 86*a*–86*d* run through the side walls of the valve body 80 (fluid ports 86*a*, 86*b*, and 86*c* are visible in FIG. 3*b*). A sealing mechanism, such as a plurality of U Cup seals 88*a* and 88*b*, provide a seal when the valve sleeve 32 covers the ports 86*a*–86*d* (as illustrated in FIG. 3*b*).

At approximately the middle of the valve body 80, the concentric bore 84 widens to form an a downward facing radial flange 90 coupled to a plunger seat 92. The widened portion of the concentric bore 84 forms a fluid passage 94. The fluid passage 94 may contain a valve mechanism, such as a plunger 96 positioned within the fluid passage 94. A biasing mechanism, such as a helical spring 98, may bias the plunger 96 against the plunger seat 92. In the illustrative embodiment, the force exerted by the helical spring 98 against the plunger seat 92 may be adjusted by means of a threaded mechanism, such as a compression nut 100, positioned within the fluid passage 94. In some embodiments, a spacer sleeve 102 may be coupled to the compression nut 100 to longitudinally position the compression nut 100 within the fluid passage 94.

A bottom portion 104 of the valve body 80 may be coupled to a guide nose 106. The guide nose 106 may be urethane, plastic, brass or another suitable material to protect the valve body 80 during use. The guide nose 106 may have a plurality of fluid passages 108*a* and 108*b* which may allow fluid to escape during times of high back pressure.

OPERATION

Figure 4:
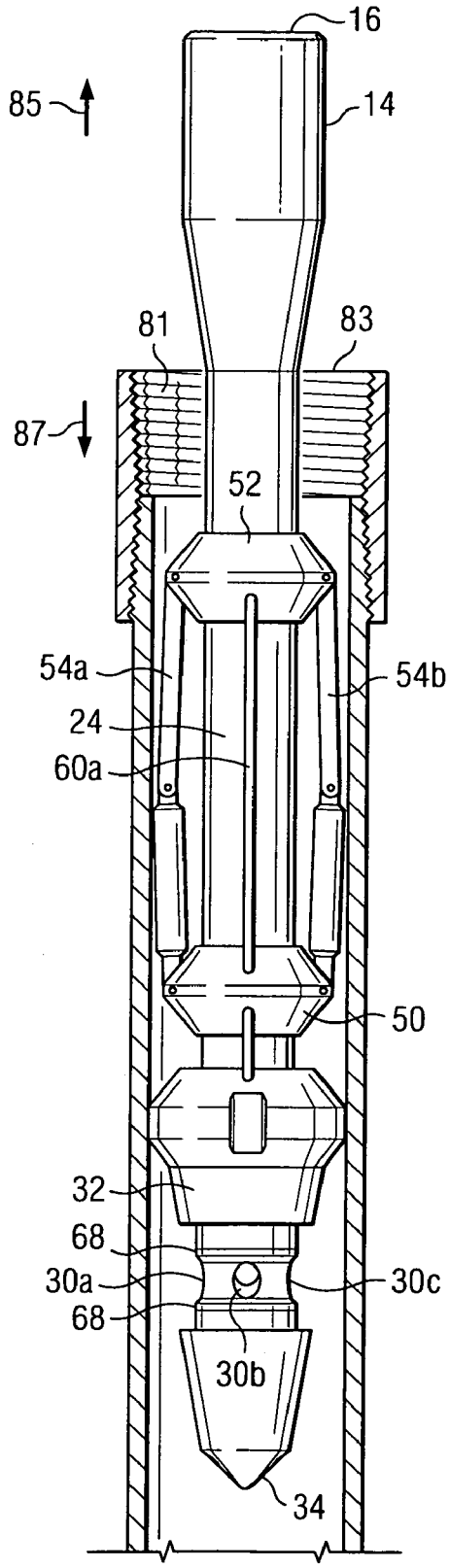
FIG. 4 is an elevation of the embodiment of FIG. 1 illustrating the embodiment in an open position.

Referring now to FIGS. 1, 2, and 4, the operation of the filling and circulating tool 10 will now be discussed. The upper connecting sub 14 of the filling and circulating tool 10 may be connected to a work string (not shown). Before insertion into the casing, filling and circulating tool 10 is in the closed position illustrated in FIGS. 1 and 2. The work string is then lowered into a well bore containing a casing 81 (shown in FIGS. 2 and 4). When the scissor arms 54*a* and 54*b* engage the top opening 83 of the casing 81, the scissor arms 54*a* and 54*b* laterally collapse inward towards the mandrel 24. The lateral collapsing of the scissor arms 54*a* and 54*b* causes the scissor arms 54*a* and 54*b* to push longitudinally against the scissor sleeve 52, which, in turn, causes the scissor sleeve 52 to move in a first direction 85 along the mandrel 24 towards the upper connecting sub 14.

As the scissor sleeve 52 moves in the first direction 85, it pulls the valve sleeve 32 in the first direction 85 via the connecting rods 60*a* and 60*b*. Thus, the valve sleeve 32 is pulled from a closed position to an open position (as illustrated in FIG. 4). In moving from the closed to open position, the valve sleeve 32 moves longitudinally in the first direction 85 along the mandrel 24 towards the top end of the upper connecting sub 14.

As the valve sleeve 32 moves from the closed position to the open position, the fluid ports 30 become exposed as illustrated in FIG. 4. Drilling fluids may now be circulated through the filling and circulating tool 10 as it is lowered into the casing. The fluids enter through the top opening 16 (FIG. 1) of the upper connecting sub 14. The fluids may flow through the central throughbore 18, and exit through the fluid ports 30*a* through 30*d*.

At some point, it may be desirable to remove the work string from the wellbore. Upon removal of the tool string, the filling and circulating tool 10 is lifted by the top connecting sub 14. When the scissor arms 54*a* and 54*b* move past the top opening 83 of the casing 81, the weight of the scissor sleeve 52 and the valve sleeve 32 push down on the scissor arms 54*a* and 54*b*, causing them to expand laterally, as illustrated in FIG. 2. This lateral expansion of the scissor arms 54*a* and 54*b* allows the scissor sleeve 52 to move longitudinally in a second direction 87 along the mandrel 24 towards the nose guide 34.

As the scissor sleeve 52 moves in the second direction 87, it also allows the valve sleeve 32 to move in the second direction 87. Thus, the valve sleeve 32 moves back from the open position illustrated in FIG. 4 to the closed position as illustrated in FIG. 2. The plurality of 0-rings 68 (FIG. 3*a* maintains a fluid-tight seal so that the fluids do not leak from the filling and circulating tool 10 as the tool is lifted from the casing opening 83.

With conventional filling and circulating tools, if a fluid pump (not shown) is left on for too long during the removal process, back pressure will develop within the tool string and the filling and circulating tool 10. The back pressure is undesirable and may result in an unsafe condition. Turning back to FIGS. 3*a* and 3*b* if high back pressure occurs while using the filling and circulating tool 10, the pressure in the throughbore 18 will overcome the biasing force exerted on the ball 74 by the spring 75 or the plunger 96 by the helical spring 98, causing the ball 74 or plunger 96 to move longitudinally down the fluid passage 72 or 94, respectively. Once the ball is away from the neck 70, fluid may flow around the ball 74 down through the fluid passage 72. The fluid may exit through the fluid passages 36*a* and 36*b* or 108*a* and 108*b*, respectively, thereby relieving any excessive back pressure building in the central throughbore 18.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims.

What is claimed is:

1. A downhole tool for attachment in a production string in a well bore having a casing comprising:

a tubular housing having a first fluid passage and a longitudinal axis;

a first movable sleeve coupled to an exterior of the housing, the first movable sleeve adapted to substantially block a flow of fluid through the first fluid passage when the first movable sleeve is in a closed position and to allow the flow of fluid when the first movable sleeve is in an open position, an actuating device coupled to the first movable sleeve and comprising a plurality of scissor arms such that in response to a first predetermined condition, the scissor arms move laterally causing the first movable sleeve to move longitudinally from the closed position to the open position, and a valve in communication with the first fluid passage, such that upon a second predetermined condition the valve allows the flow of fluid through a second fluid passage.

2. The downhole tool of claim 1 wherein the first fluid passage comprises a longitudinal fluid passage and at least one fluid exit port.

3. The downhole tool of claim 2 wherein the first movable sleeve is adapted to slidably move between the closed position and the open position, wherein in the closed position the first movable sleeve covers the at least one fluid exit port.

4. The downhole tool of claim 1 wherein the actuating device further comprises:

a second movable sleeve, wherein the second movable sleeve is coupled to an exterior of the housing, the first movable sleeve and the plurality of scissor arms.

5. The downhole tool of claim 4 further comprising an anchor, wherein the anchor is coupled to the housing, the second movable sleeve and the plurality of scissor arms, and wherein the anchor allows the second movable sleeve to move relative to the housing.

6. The downhole tool of claim 4 further comprising a plurality of connecting rods coupling the first movable sleeve to the second movable sleeve such that when the second movable sleeve moves, the first movable sleeve moves.

7. The downhole tool of claim 1 wherein the valve comprises:

an entrance port of the second fluid passage, a ball, a biasing mechanism positioned to exert a biasing force upon the ball to normally maintain the ball against the entrance port such that fluid flow is prevented from entering the second fluid passage.

8. The downhole tool of claim 1 wherein the valve comprises:

an entrance port of the second fluid passage, a plunger, a biasing mechanism positioned to exert a biasing force upon the plunger to normally maintain the plunger against the entrance port such that fluid flow is prevented from entering the second fluid passage.

9. The downhole tool of claim 1, further comprising a guide mounted to the body to assist in centralizing it in the casing and to protect the tool as it is inserted into the casing.

10. A fill tool for a casing, the fill tool comprising:

a body having an internal passage leading to at least one outlet port adjacent a lower end of the body;

an actuator comprising a plurality of scissor arms positioned about the body and adapted to laterally collapse upon insertion into the casings; and a movable sleeve positioned external to the internal passage, the movable sleeve being movable between an open position and a closed position with respect to the at least one outlet port in response to the lateral movement of the actuator upon insertion into and substantial removal of the body from the casing.

11. The fill tool of claim 10, further comprising a second movable sleeve coupled to the first movable sleeve and the scissor arms such that when the scissor arms move laterally, the first movable sleeve and the second movable sleeve move longitudinally.

12. The fill tool of claim 11 further comprising an anchor, wherein the anchor is coupled to the housing, the second movable sleeve and the plurality of scissor arms, and wherein the anchor allows the second movable sleeve to move relative to the housing.

13. The fill tool of claim 10, further comprising:

a guide mounted to the body to assist in centralizing it in the casing and to protect the tool as it is inserted into the casing.

14. The fill tool of claim 10, further comprising a valve in communication with the internal passage, such that when the movable sleeve is in a closed position with respect to the at least one outlet port and upon a predetermined condition, the valve is adapted to allow the flow of fluid through a fluid passage other than the at least one outlet port.

15. A method for filling a well casing, the method comprising:

coupling a fill tool to a lower end of a tool string, the fill tool having: a first fluid passage; a movable sleeve in communication with the first fluid passage and positioned in a closed configuration about an exterior of the tool so as to block the flow of fluid through the first fluid passage; and an actuating device comprising a plurality of scissor arms coupled to the movable sleeve, lowering the tool into an opening of a well casing to actuate the actuating device by laterally collapsing the scissor arms thereby moving the movable sleeve to an open position so as to allow the flow of fluid through the first fluid passage, and injecting fluid into the tool string such that the fluid flows through the fluid passage.

16. The method of claim 15 further comprising:

raising the tool from the well casing to actuate the actuating device by laterally expanding the scissor arms thereby moving the movable sleeve to a closed position so as to block the flow of fluid through the first fluid passage.

17. The method of claim 16 wherein the fill tool has a valve such that when the movable sleeve is in a closed position and blocking the flow of fluid through the first fluid passage, upon a predetermined condition the valve allows the flow of fluid through a second fluid passage.

* * * * *